US011219992B2

(12) United States Patent
Frank

(10) Patent No.: US 11,219,992 B2
(45) Date of Patent: Jan. 11, 2022

(54) SPRING WINDING APPARATUS AND METHOD OF USE

(71) Applicant: James L. Frank, Wesley Chapel, FL (US)

(72) Inventor: James L. Frank, Wesley Chapel, FL (US)

(73) Assignee: James L. Frank Door Service Inc., Wesley Chapel, FL (US)

( * ) Notice: Subject to any disclaimer, the term of this patent is extended or adjusted under 35 U.S.C. 154(b) by 472 days.

(21) Appl. No.: 16/355,226

(22) Filed: Mar. 15, 2019

(65) Prior Publication Data

US 2020/0290188 A1 Sep. 17, 2020

(51) Int. Cl.

| | |
|---|---|
| ***B25B 27/30*** | (2006.01) |
| ***E05D 13/00*** | (2006.01) |
| ***B21F 3/00*** | (2006.01) |

(52) U.S. Cl.

CPC ..... *B25B 27/30* (2013.01); *B21F 3/00* (2013.01); *B25B 27/302* (2013.01); *B25B 27/306* (2013.01); *E05D 13/1261* (2013.01)

(58) Field of Classification Search

CPC ... B21F 3/00; E05D 13/1261; E05D 13/1215; E05D 13/1253

USPC ..... 81/57.3, 57.13, 58.2; 160/191, 192

See application file for complete search history.

(56) References Cited

U.S. PATENT DOCUMENTS

| | | | | |
|---|---|---|---|---|
| 3,921,761 | A * | 11/1975 | Votroubek | E05D 13/1261 185/39 |
| 6,508,461 | B1 | 1/2003 | Trevorrow et al. | |
| 8,567,567 | B1 * | 10/2013 | Turner | F03G 1/08 185/39 |
| 8,616,093 | B1 * | 12/2013 | Maniak | E05D 13/1261 81/57.13 |
| D838,562 | S | 1/2019 | Paulsen et al. | |

OTHER PUBLICATIONS

Surewinder. Surewinder LLC. Date Accessed: May 13, 2019. https://www.surewinder.com/.

* cited by examiner

*Primary Examiner* — David B. Thomas
*Assistant Examiner* — Thomas Raymond Rodgers
(74) *Attorney, Agent, or Firm* — Smith & Hopen, P.A.; Paul Murty

(57) ABSTRACT

A tool assembly designed to couple to a torsion spring and torsion rod to wind and unwind the torsion spring on the torsion rod. The tool assembly includes a variety of components in mechanical communication with one other to rotate the torsion spring. Specifically, the assembly includes a worm gear in mechanical communication with a ring gear and a set of brackets securable to a torsion spring. Between the ring gear and the brackets are a series of plates arranged and assembled on a base, providing a singular device within the assembly that a user can grip to manipulate a torsion spring in a safer manner than possible in the prior art. A drill or other device can couple to attachment points in mechanical communication with the worm gear to rotate the worm gear at a greater rate, thereby reducing the winding and unwinding time of the torsion spring.

12 Claims, 13 Drawing Sheets

SPRING WINDING APPARATUS AND METHOD OF USE

BACKGROUND OF THE INVENTION

1. Field of the Invention

This invention relates, generally, to tools aiding in the winding of springs. More specifically, it relates to a spring winding apparatus designed for use with springs, such as torsion springs, to provide an efficient and safe method of winding and unwinding the springs.

2. Brief Description of the Prior Art

Traditionally, torsion springs used in combination with a garage door include a coil portion and a central axis, about which the coil portion is wound. A torsion bar is disposed along the central axis of the torsion spring, with the spring being wound around the bar. One end of the spring is secured by a plate to an anchoring point, such as a wall. The other end of the spring is wound until there is sufficient torque, and subsequently secured to a shaft. On a garage door, a torsion spring stores energy when wound, with that energy being transferred to cables attached to the spring and to the bottom of a garage door, such that the cables can open and close the garage door. If a torsion spring breaks, a garage door will likely not function correctly, either by becoming incapacitated, or by opening asymmetrically and being off-track.

The replacement of a torsion spring can be a dangerous and inefficient task. To remove the spring for maintenance or replacement, the spring must be unwound to transfer energy from the coils. Similarly, to install the spring, the spring must be wound to transfer energy to the coils. Regardless of whether the springs are being wound or unwound, the high amount of energy stored within the springs leads to danger for amateurs and professionals alike, in that a slight misstep can lead to the spring unwinding, similar to a propeller, launching away from the torsion bar. Such a misstep can lead to cosmetic damage to items and structures surrounding the torsion springs, as well as serious physical damage or death to the person attempting to remove or install the springs. Moreover, since the springs require a large amount of torque, removing or installing torsion springs is physically taxing, representing danger to an installer's muscles and limbs due to the repetitive motion associated with each turn required to wind or unwind the springs.

Attempts have been made to provide a tool that can help in the removal and installation of torsion springs by reducing the physical taxation incurred by a human working on the torsion springs. For example, U.S. Pat. No. 6,508,461 to Trevorrow describes an apparatus for spring tensioning. However, the apparatus described therein includes multiple moving components, with each subsequent component increasing the risk of the device slipping or of a misstep leading to danger to the installer, those around the installer, and the structures and items surrounding the spring. For example, the apparatus includes combinations of an adapter mechanism, a wrench, a collar, and a collar adapter. The components work together to wind and unwind torsion springs, but are separate components in the system described in the application, failing to form a singular unit that is user-friendly and that mitigates the dangers, risks, and physical labor involved in installing and removing torsion springs. An example of the apparatus described in the '461 Patent can be found in the winder tools sold under the trade name E-Z RATCH™, which still requires a great deal of manual labor in addition to the multiple parts discussed above.

Accordingly, what is needed is a spring winding apparatus that safely, easily, and efficiently winds and unwinds a torsion spring with reduced injury risk for an installer. However, in view of the art considered as a whole at the time the present invention was made, it was not obvious to those of ordinary skill in the field of this invention how the shortcomings of the prior art could be overcome.

All referenced publications are incorporated herein by reference in their entirety. Furthermore, where a definition or use of a term in a reference, which is incorporated by reference herein, is inconsistent or contrary to the definition of that term provided herein, the definition of that term provided herein applies and the definition of that term in the reference does not apply.

While certain aspects of conventional technologies have been discussed to facilitate disclosure of the invention, Applicants in no way disclaim these technical aspects, and it is contemplated that the claimed invention may encompass one or more of the conventional technical aspects discussed herein.

The present invention may address one or more of the problems and deficiencies of the prior art discussed above. However, it is contemplated that the invention may prove useful in addressing other problems and deficiencies in a number of technical areas. Therefore, the claimed invention should not necessarily be construed as limited to addressing any of the particular problems or deficiencies discussed herein.

In this specification, where a document, act or item of knowledge is referred to or discussed, this reference or discussion is not an admission that the document, act or item of knowledge or any combination thereof was at the priority date, publicly available, known to the public, part of common general knowledge, or otherwise constitutes prior art under the applicable statutory provisions; or is known to be relevant to an attempt to solve any problem with which this specification is concerned.

BRIEF SUMMARY OF THE INVENTION

The long-standing but heretofore unfulfilled need for an assembly to more efficiently and safely wind and unwind torsion springs for removal and installation from a torsion rod is now met by a new, useful, and nonobvious invention.

The novel assembly includes a base, including a handle opposite a head. The head includes a first portion and a second portion that are separated by an opening. A worm gear is disposed on the base between the handle and the head. A ring gear is disposed proximate to a front side of the base, with the ring gear being in mechanical communication with the worm gear. The ring gear includes first hemispherical component opposite and separable from a second hemispherical component. An aperture is centrally-disposed within the ring gear, partially defined by the first hemispherical component and the second hemispherical component. The centrally-disposed aperture is configured to surround a torsion rod upon which a torsion spring is wound. At least two brackets are disposed proximate to a rear side of the base, with the brackets being in mechanical communication with the ring gear. The brackets are couplable to attachment points on a torsion spring. Because of the mechanical communications between the worm gear, the ring gear, and the brackets, a rotation of the worm gear rotates the ring gear and the brackets, thereby rotating the torsion spring to wind or unwind the torsion spring.

In an embodiment of the assembly, a U-plate is disposed between the base and the at least two brackets. The U-plate includes at least two through-holes disposed therein, the through-holes disposed to receive bolts secured through through-holes of the ring gear. The brackets secure against the bolts. The U-plate is disposed within and in mechanical communication with a first horseshoe-shaped plate, with the first horseshoe-shaped plate having an inner diameter greater than an outer diameter of the U-plate. As such, the plate can rotate within the first horseshoe-shaped plate. A spacer plate is disposed between the first horseshoe-shaped plate and the head of the base, the spacer plate separating the first horseshoe-shaped plate from the head of the base, and separating the U-plate from the head of the base, such that the U-plate can rotate.

In an embodiment, a second horseshoe-shaped plate is disposed between the first horseshoe-shaped plated and the brackets, with the second horseshoe-shaped plate including an inner diameter smaller than the inner diameter of the first horseshoe-shaped plate. As such, the first horseshoe-shaped plate and the U-plate rest against the second horseshoe-shaped plate, and the U-plate is rotatable against the second horseshoe-shaped plate and within the first horseshoe-shaped plate.

In an embodiment, the U-plate, the first horseshoe-shaped plate, the second horseshoe-shaped plate, and the spacer plater are disposed on the front side of the base between the head and the ring gear. In this embodiment, the spacer plate is disposed between the head and the first horseshoe-shaped plate; and the second horseshoe-shaped plate is disposed between the first horseshoe-shaped plate and the ring gear.

The assembly includes at least one attachment point in mechanical communication with the worm gear. The attachment point can be disposed on a holder within which the worm gear is disposed. A mechanical translation of the attachment point rotates the worm gear and the other components of the assembly. A tool, such as a drill, is couplable to the attachment to mechanically translate the attachment point, thereby rotating the worm gear, the ring gear, the brackets, and a torsion spring.

An object of the invention is to provide an assembly through which a user can easily and safely install and remove a torsion spring from a torsion rod, without expending vast amounts of physical energy, while mitigating the dangerous associated with installing and removing springs including high amounts of stored mechanical energy.

These and other important objects, advantages, and features of the invention will become clear as this disclosure proceeds.

The invention accordingly comprises the features of construction, combination of elements, and arrangement of parts that will be exemplified in the disclosure set forth hereinafter and the scope of the invention will be indicated in the claims.

BRIEF DESCRIPTION OF THE DRAWINGS

For a fuller understanding of the invention, reference should be made to the following detailed description, taken in connection with the accompanying drawings, in which.

DETAILED DESCRIPTION OF THE INVENTION

In the following detailed description of the preferred embodiments, reference is made to the accompanying drawings, which form a part thereof, and within which are shown by way of illustration specific embodiments by which the invention may be practiced. It is to be understood that other embodiments may be utilized and structural changes may be made without departing from the scope of the invention.

As used in this specification and the appended claims, the singular forms "a," "an," and "the" include plural referents unless the content clearly dictates otherwise, As used in this specification and the appended claims, the term "or" is generally employed in its sense including "and/or" unless the context clearly dictates otherwise.

The present invention includes a tool assembly couplable to a torsion spring and torsion rod to wind and unwind the torsion spring on the torsion rod. The tool assembly includes a worm gear in mechanical communication with a circular gear, with the circular gear in mechanical communication with a set of brackets designed to secure to attachment points on a torsion spring. The components of the tool assembly are assembled on a base and a series of plates, providing a singular device within the assembly that a user can grip and manipulate a torsion spring in a safer manner than possible in the prior art. A drill or other device can couple to attachment points in mechanical communication with the worm gear to rotate the worm gear at a greater rate, thereby reducing the winding and unwinding time of the torsion spring, and reducing the dangers associated with torsion spring installation and removal.

Figure 1:
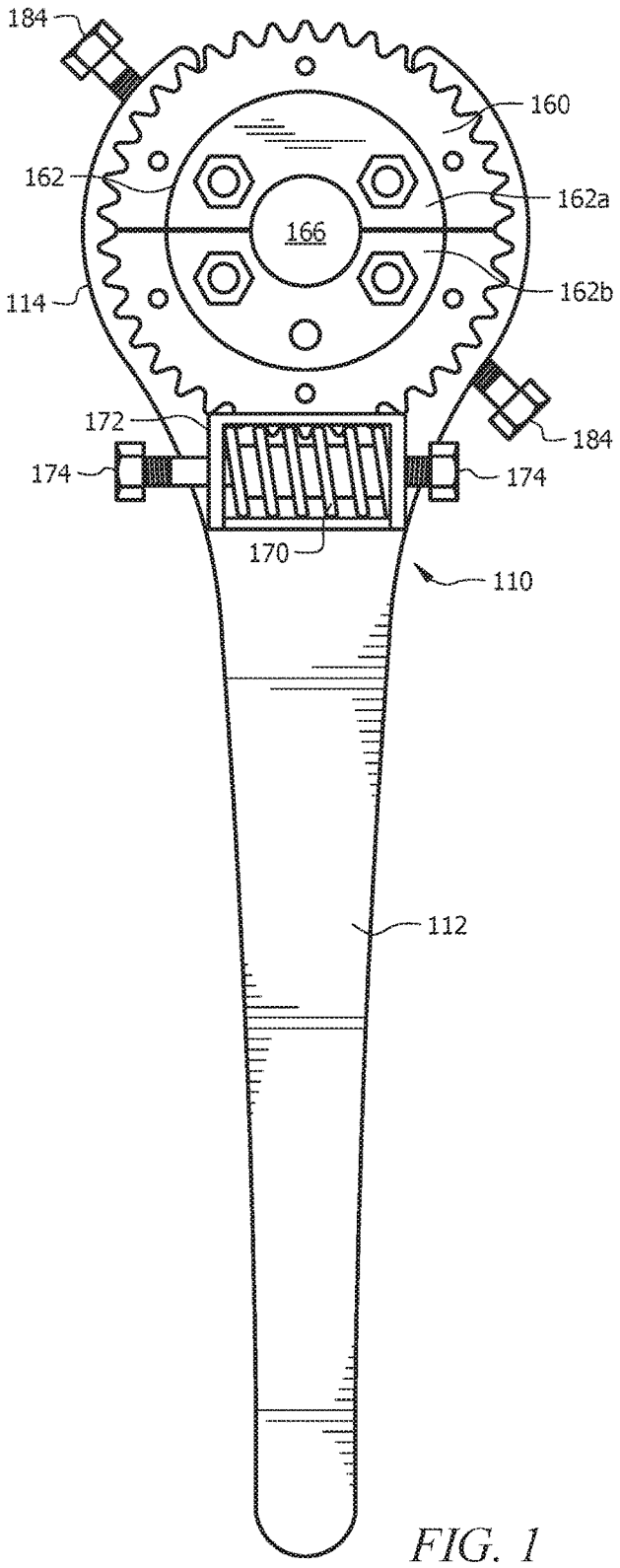
FIG. 1 is a front elevation view of a torsion spring winding assembly, in accordance with an embodiment of the present invention.

As shown in FIG. 1 torsion spring winding assembly 100 (the assembly is shown in greater detail in FIG. 13) includes base 110, which includes head 114 opposite elongated handle 112, providing a comfortable grasping point for a user's hand, while also being capable of providing sufficient torque to the torsion spring being installed or removed. In use, head 114 and its associated components (which will be discussed in greater detail below) are designed to secure against a torsion spring to wind and unwind the torsion spring, while a user can grip and/or hold handle 112 of base 110. Similarly, in use, handle 112 of base 110 can rest against a solid structure, such as a strut on a garage door. While it is appreciated that various lengths of base 110 are contemplated, in an embodiment base 110 is approximately 18" in length.

Head 114 includes multiple components designed in such a way as to provide an attachment to a torsion spring as well as a mechanism through which a user can wind and unwind the torsion spring. As shown in FIG. 1, head 114 includes ring gear 160 disposed at an end thereof, such that a user can interact with the gear. Ring gear 160 (which can be alternatively described as wheel gear 160) includes support plate 162, with support plate 162 being laterally offset from teeth on ring gear 160. Accordingly, support plate 162 and ring gear 160 are concentrically aligned, as shown in FIG. 1. Moreover, support plate 162 mates to an inner lateral surface of ring gear 160, with support plate 162 being sized and shaped to avoid contact with worm gear 170 (which can be alternatively described as a helical gear, and is described in greater detail below), such that ring gear 160 and support plate 162 can rotate without interference. Support plate 162 can be a singular, substantially circular component, or can be two hemispherical components, such as 162*a* and 162*b*, as shown in FIG. 1. Regardless of whether ring gear 160 is comprised of a singular component or comprised of the hemispherical components shown in FIG. 1, head 114 includes a centrally-disposed aperture 166, which is sized and shaped to surround a torsion rod during spring installation or removal. In an embodiment, centrally-disposed aperture 166 is approximately 1.125" in diameter to surround a torsion rod. The connection between head 114 and a torsion spring still be discussed below, particularly in reference to FIGS. 11-13.

Also shown in FIG. 1 is worm gear 170 and its associated assembly. Worm gear 170 is in mechanical communication with ring gear 160, such that the coil of worm gear 170, when rotated about a central axis of worm gear 170, rotates ring gear 160 either clockwise or counter-clockwise. The rotation of ring gear 160 in turn rotates other components of torsion spring winding assembly 100, as will be discussed below. Worm gear 170 is disposed within holder 172, which is secured against base 110 via welding, bolting, adhering, or other attachment mechanisms. Disposed on an outer portion of holder 172 is at least one attachment point 174, which is a bolt in the embodiment shown in FIG. 1. Attachment point 174 is in mechanical communication with worm gear 170, such as by forming a bar engaged with worm gear 170, wherein worm gear 170 rotates when the bar rotates as a singular unit. As such, the rotation of attachment point 174 in turn rotates worm gear 170 and ring gear 160. By providing attachment point 174 in the form of a bolt or screw head, an external tool can be used to rotate the gear assembly, instead of a manual rotation as is typical in the prior art of torsion spring winding and unwinding. While FIG. 1 depicts attachment point 174 as a bolt, it is appreciated that attachment point 174 can be any size and shape, so long as attachment point 174 is capable of mating with a tool, such as a drill, a wrench, a socket, a screwdriver, a ratchet, or any other tool capable of engaging with and mechanically translating attachment point 174. For example, in an embodiment, attachment point 174 is a ¾" nut sized and shaped to be mechanically translated by a reciprocal drill bit, wrench, or socket. Moreover, by providing attachment point 174 in the form of a common mating component, attachment point 174 is replaceable in the event that attachment point 174 is stripped, worn, or otherwise damaged.

Figure 2:
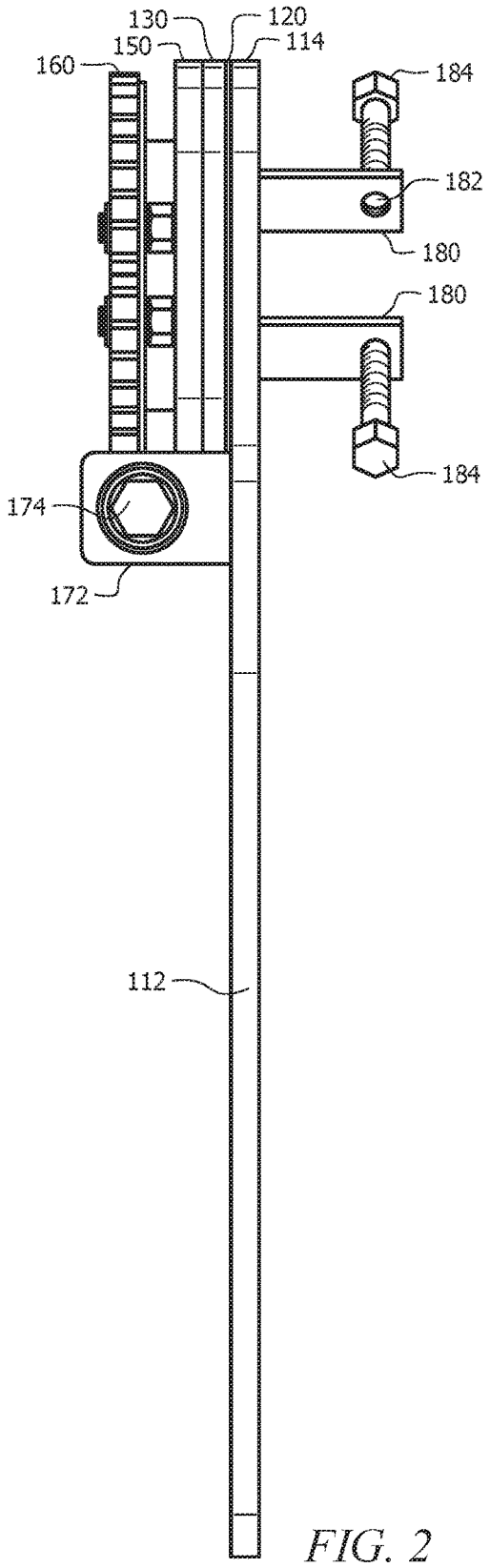
FIG. 2 is a right-side elevation view of the torsion spring winding assembly of FIG. 1.

FIG. 2 is a side view of the tool shown in FIG. 1, with FIG. 2 showing the depth of head 114 and the various components thereof. As shown in FIG. 2, head 114 and ring gear 160 are in mechanical communication with one another, but are separated by other components. For example, as shown in FIG. 2, the assembly includes spacer 120 on a front side of base 110, separating head 114 from first horseshoe plate 130. Spacer 120 is thin, with spacer 120 being approximately 1/32" thick. Similarly, second horseshoe plate 150 separates first horseshoe plate 130 from ring gear 160. However, each of the components is in mechanical communication with the other components, as will be shown in exploded views described below. Ring gear 160 can be described as being disposed on a front side of base 110. Finally, FIG. 2 shows L-brackets 180 which are secured against U-plate 140 on a rear side of base 110 (U-plate 140 will be discussed in further detail below). L-brackets 180 are in mechanical communication with ring gear 160. Each L-bracket 180 includes torsion spring attachment bolt 184 designed to be inserted through aperture 182. Each torsion spring attachment bolt 184 couples with a torsion spring by being inserted and retained within a corresponding cavity on the torsion spring cone.

Figure 3:
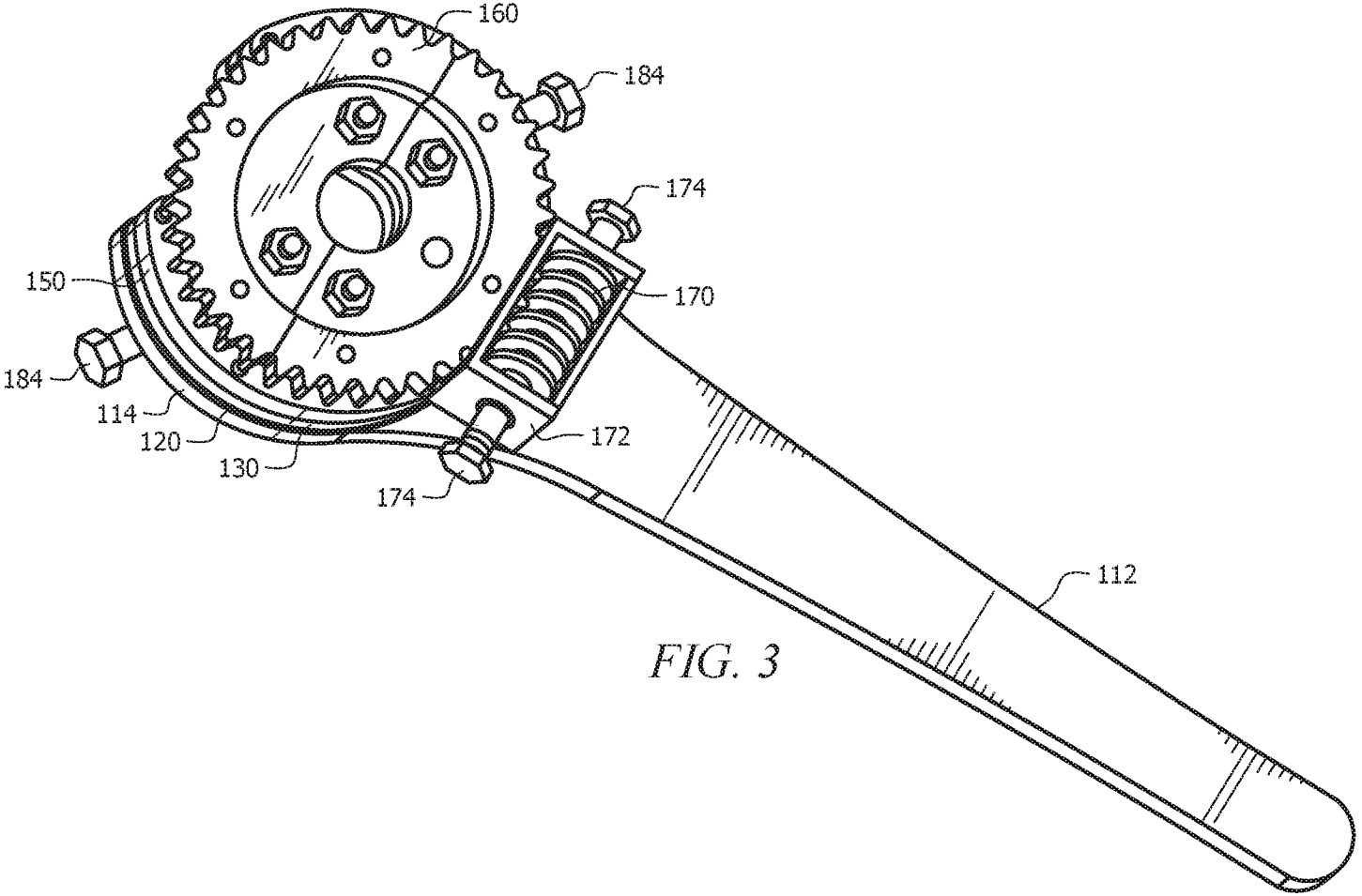
FIG. 3 is a front perspective view of the torsion spring winding assembly of FIG. 1.
Figure 4:
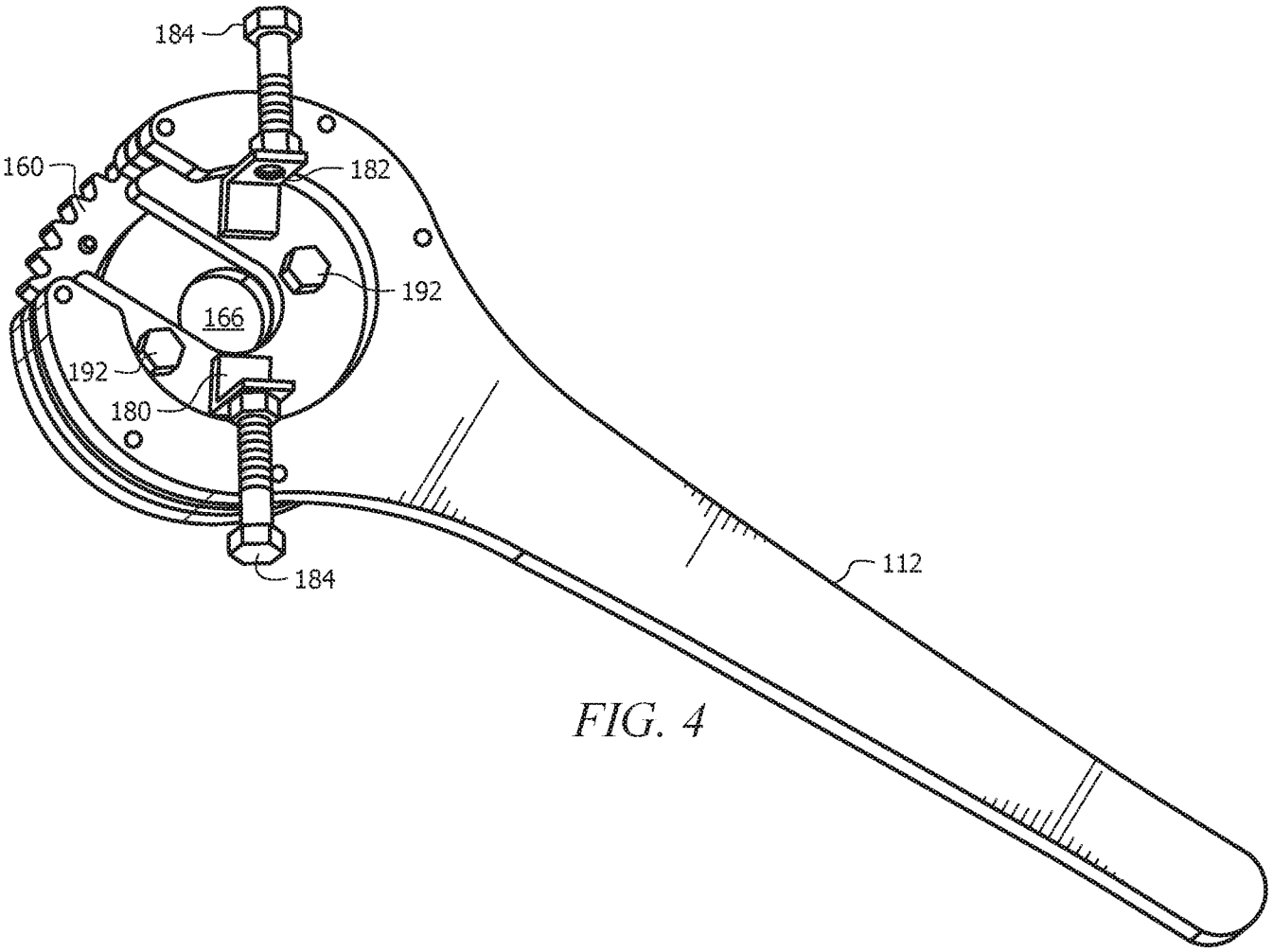
FIG. 4 is a rear perspective view of the torsion spring winding assembly of FIG. 1.

FIGS. 3-4 provide perspective views of the assembly, showing the orientation of the components described above in an embodiment of the present invention. FIG. 3 depicts a front perspective, and FIG. 4 depicts a rear perspective, of the assembly. Importantly, as shown in FIGS. 3-4, many of the components of the assembly (including head 114, thin spacer 120, first horseshoe plate 130, second horseshoe plate 150, and U-plate 140) include an opening or a gap disposed between two sides of the individual components, making the components horseshoe-spaced or U-shaped. For example, U-plate 140 is substantially round in shape and includes an elongated U-shaped slot disposed between two sides thereof, thereby creating an opening or gap in U-plate 140. The openings are beneficial, as they improve the efficiency and ease of surrounding a torsion rod with the tool, which will be shown in later figures and discussed below.

As shown in FIG. 4, L-brackets 180 are secured against heads of bolts 192, which are in communication with U-plate 140 disposed is proximate to head 114. Bolts 192, which function to secure U-plate 140 to ring gear 160, such that when ring gear 160 rotates, the round U-plate 140 in turn rotates. The two L-brackets 180 shown in FIG. 4 are secured against two of bolts 192, such as via welding, threading, adhering, or other attachment mechanisms. Accordingly, each L-bracket 180 rotates when ring gear 160 rotates.

Figure 5A:
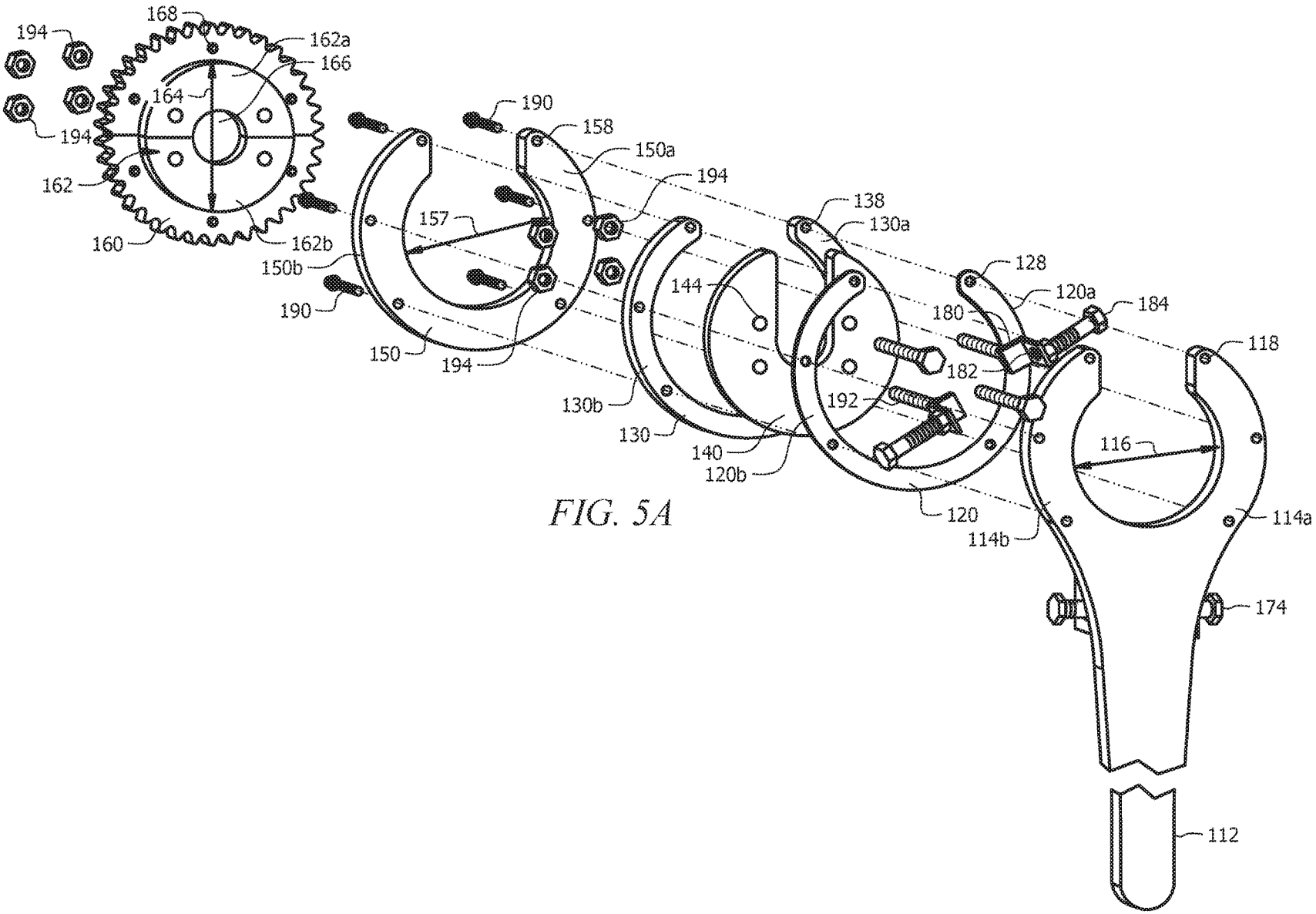
FIG. 5A is an exploded rear-and-right-side perspective view of the torsion spring winding assembly of FIG. 1.
Figure 5B:
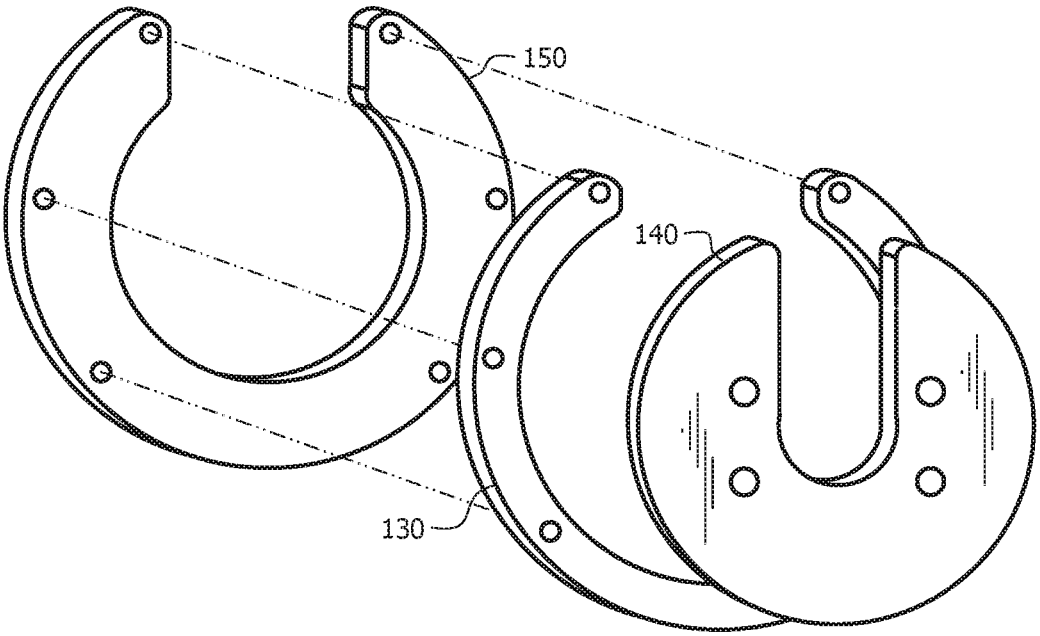
FIG. 5B is an exploded perspective view of internal components of the torsion spring winding assembly of FIG. 1.
Figure 5C:
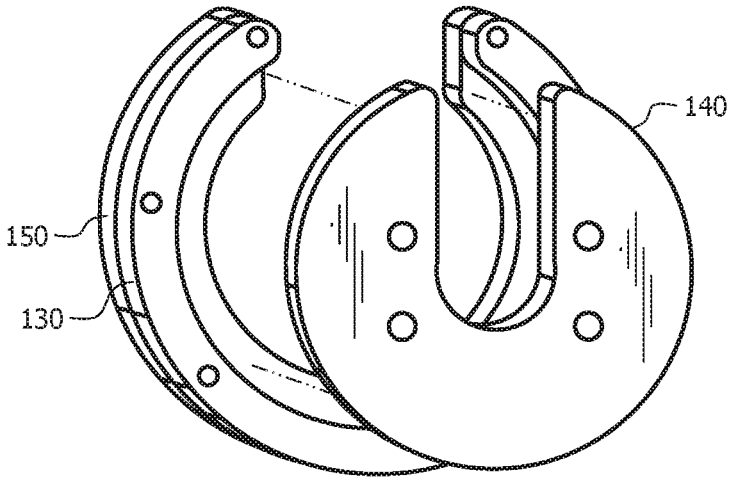
FIG. 5C is a partially-exploded perspective view of internal components of the torsion spring winding assembly of FIG. 5B, showing how the components fit together.

FIGS. 5A-5C provide exploded views of the components of the assembly, showing how the embodiment of FIGS. 1-4 is assembled. As shown in FIG. 5A in particular, each of the components including head 114, spacer 120, first horseshoe plate 130, U-plate 140, and second horseshoe plate 150 includes a gap between two free ends established by the respective shapes of the individual components. Said another way, each of the components including head 114, spacer 120, first horseshoe plate 130, U-plate 140, and second horseshoe plate 150 has a discontinuous circumference, creating two free ends that establish a lateral passage into a central receiving space, and ultimate into centrally-disposed aperture 166. Accordingly, head 114 includes first portion 114*a* opposite second portion 114*b*, with an opening disposed therebetween, and central aperture 116 partially defined by the opening disposed between first portion 114*a* and second portion 114*b*. Similarly, spacer 120 includes first portion 120*a* opposite second portion 120*b*, similarly with an opening disposed therebetween. First horseshoe plate 130 also includes first portion 130*a* opposite second portion 130*b*, again with an opening disposed therebetween. Second horseshoe plate 150 includes first portion 150*a* opposite second portion 150*b*, similarly with an opening disposed therebetween. Finally, U-plate 140 is substantially round and U-shaped, including a U-shaped slot between each of the subsequent sides of the U-shape.

FIG. 5A also shows how the components of the assembly attach to each other, as well as the relationships between the components. As shown in FIG. 5A, most of the interior plates includes at least two, and preferably a plurality of, attachment holes disposed therein. For example, second horseshoe plate 150 includes attachment holes 158; first horseshoe plate 130 includes attachment holes 138; space 120 includes attachment holes 128; and head 114 includes attachment holes 118. At least two, and preferably a plurality of, screws 190 are insertable through the attachment holes to secure the interior plates together and to head 114 of base 110. As a result, the components of the assembly are in mechanical communication with one another, such that a rotation of ring gear 160 can rotate the other plates of the assembly. In addition, attachment holes 168 disposed within ring gear 160 can be used to secure support plate 162 to ring gear 160, in an embodiment in which ring gear 160 and support plate 162 are separate components.

Also shown in FIG. 5A is the relationship between L-brackets 180, ring gear 160, and U-plate 140. U-plate 140 includes at least two, and preferably a plurality of, attachment holes 144. Similarly, ring gear 160 includes matching attachment holes disposed within support plate 162 of ring gear 160. Ring gear 160 and U-plate 140 are in mechanical communication with each other via at least two, and preferably a plurality of, bolts 192 insertable through attachment holes 144 of U-plate and the attachment holes of ring gear 160, with nuts 194 securing bolts 192 against ring gear 160. In an embodiment, nuts 194 are approximately ¾". Moreover, L-brackets 180 are secured to bolts 192, as discussed above, such that L-brackets 180 are in turn in mechanical communication with ring gear 160. As such, a rotation of ring gear 160 rotates L-brackets 180, and in turn a torsion spring when the tool is secured against the torsion spring via L-brackets 180. FIG. 5A also shows the relative thicknesses of each of the components, including ring gear 160, second horseshoe plate 150, first horseshoe plate 130, U-plate 140, spacer 120, and head 114. In an embodiment, other than spacer 120, which is thinner than the other components, the plates, and head portions (including the handle portion of the base as well) are formed from ¼" thick steel to provide a strong and rigid assembly, thereby mitigating the risk of the assembly components breaking down during repeated use.

Figure 5D:
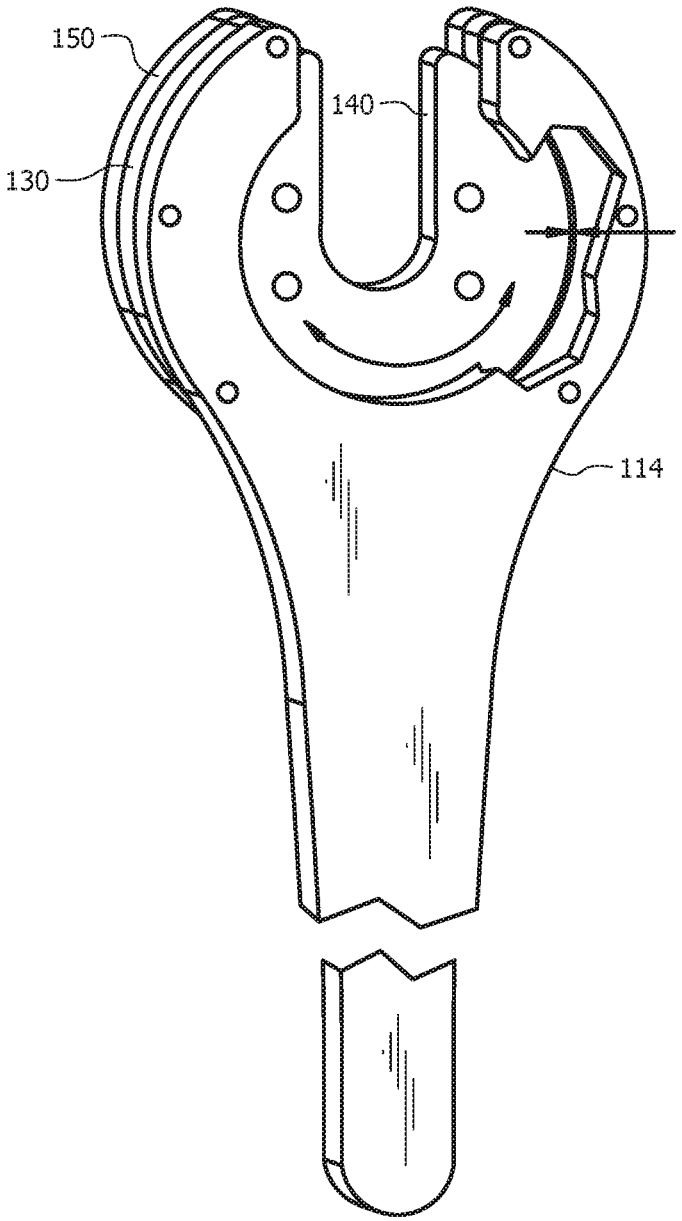
FIG. 5D is a partially-assembled perspective view of the torsion spring winding assembly of FIG. 1, showing how the U-plate rotates within the assembly, in accordance with an embodiment of the present invention.

FIGS. 5B-5D depict the relationship between first horseshoe plate 130, second horseshoe plate 150, and U-plate 140. As shown in FIGS. 5B-5C, an inner diameter of second horseshoe plate 150 is smaller than an inner diameter of first horseshoe plate 130, while the outer diameters of the plates is substantially equal. In addition, an outer diameter of U-plate 140 is slightly less than the inner diameter of first horseshoe plate 130, such that first horseshoe plate 130 surrounds and receives U-plate 140 between the first and second portions of first horseshoe plate 130. Moreover, since the inner diameter of second horseshoe plate 150 is smaller than the inner diameter of first horseshoe plate 130, U-plate 140, when received within first horseshoe plate 130, rests on a portion of second horseshoe plate 150. As such, U-plate 140 can rotate within first horseshoe plate 130, while second horseshoe plate 150 prevents U-plate 140 from falling or slipping therethrough. The rotation of U-plate 140 within first horseshoe plate 130 is shown in detail in FIG. 5D, which provides a partially cut-out view of the assembly to show that U-plate 140 rotates without being able to translate away from either second horseshoe plate 150 or head 114.

Figure 6:
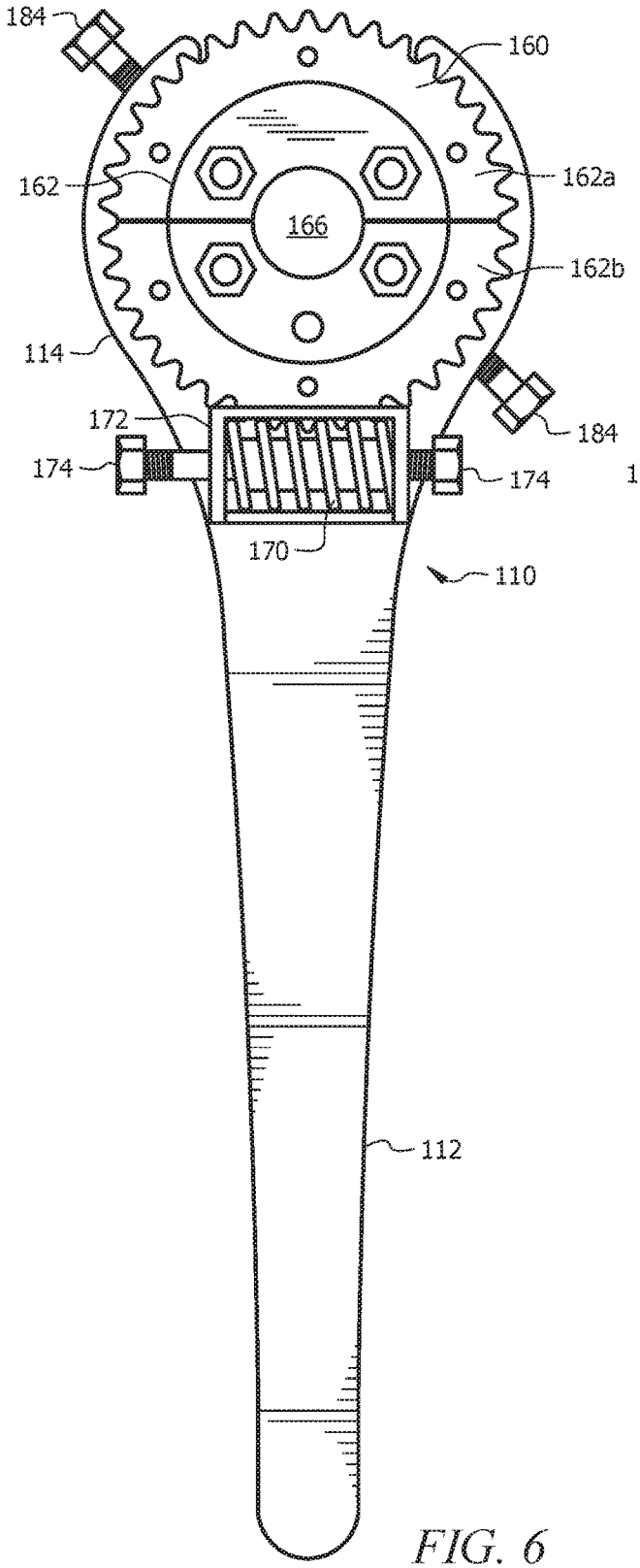
FIG. 6 is a front elevation view of a torsion spring winding assembly, in accordance with an embodiment of the present invention.
Figure 7:
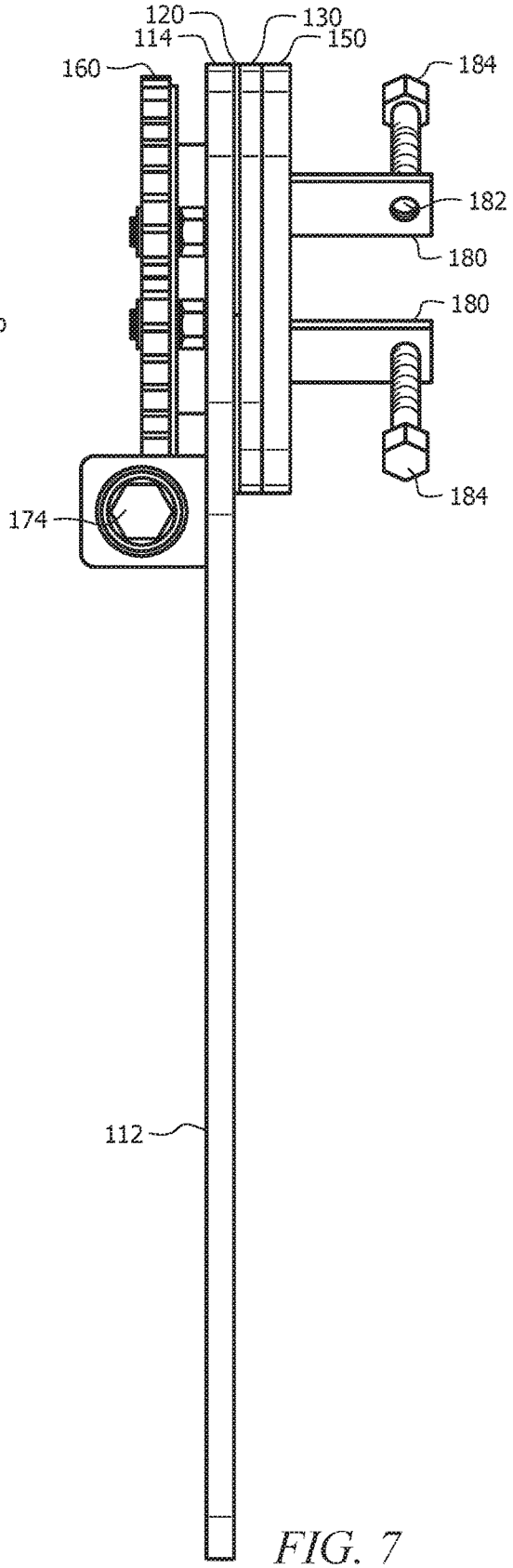
FIG. 7 is a right-side elevation view of the torsion swing winding assembly of FIG. 6.
Figure 8:
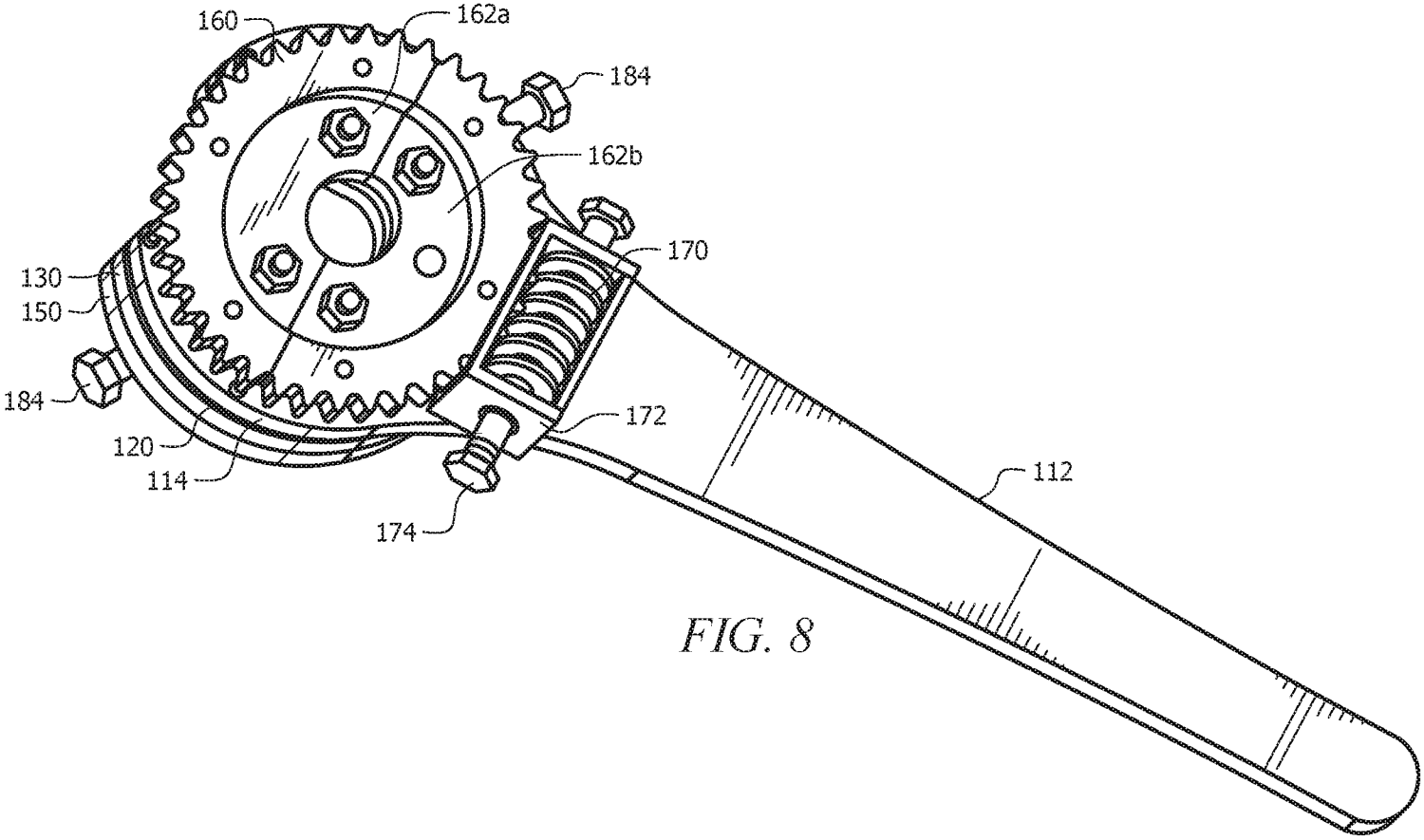
FIG. 8 is a front perspective view of the torsion spring winding assembly of FIG. 6.
Figure 9:
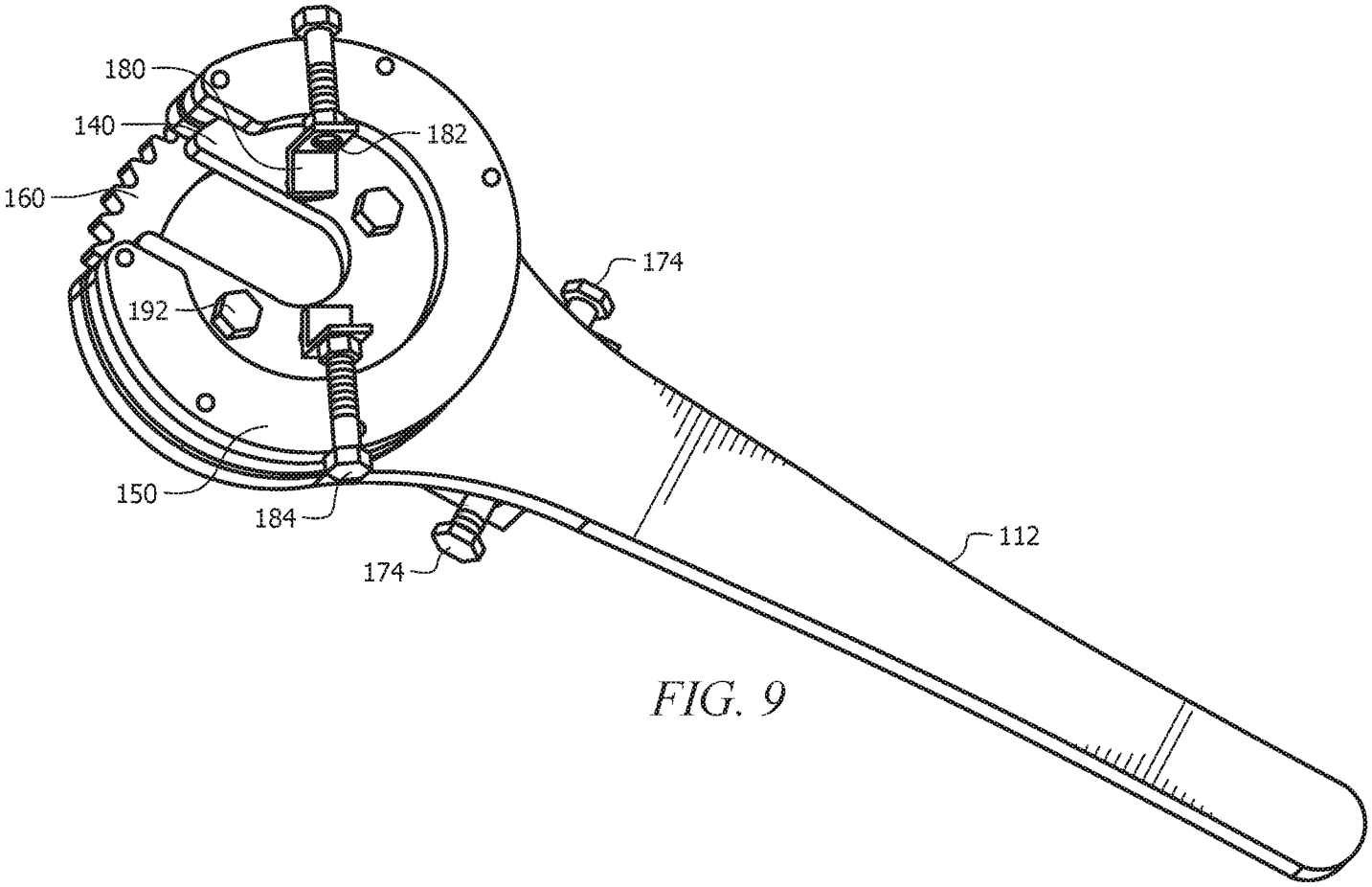
FIG. 9 is a rear perspective view of the torsion spring winding assembly of FIG. 6.

FIGS. 6-10 depict an alternative orientation of the tool assembly, with similar components to the embodiment of FIGS. 1-5C. Accordingly, FIG. 6 depicts an alternative embodiment of torsion spring winding assembly 100, showing a front view of the assembly, including ring gear 160 (or wheel gear 160) in mechanical communication with head 114. FIG. 7 shows a side perspective view of the assembly, which shows the orientation of the components of the assembly. As shown in FIG. 7, ring gear 160 (which can be described as being on a front side of base 110) is disposed adjacent to head 114, with ring gear 160 being secured against nuts 194 of bolts 192. Toward the rear side of the assembly, head 114 is disposed adjacent to spacer 120, which separates head 114 from first horseshoe plate 130. First horseshoe plate 130 rests against second horseshoe plate 150. L-brackets 180 are disposed at a rear terminal portion of the assembly, with L-brackets 180 being in mechanical communication with ring gear 160. FIG. 8-9 depict front and rear perspective views of the embodiment of FIG. 6, and are similar to the views depicted in FIGS. 3-4, described in detail above.

Figure 10:
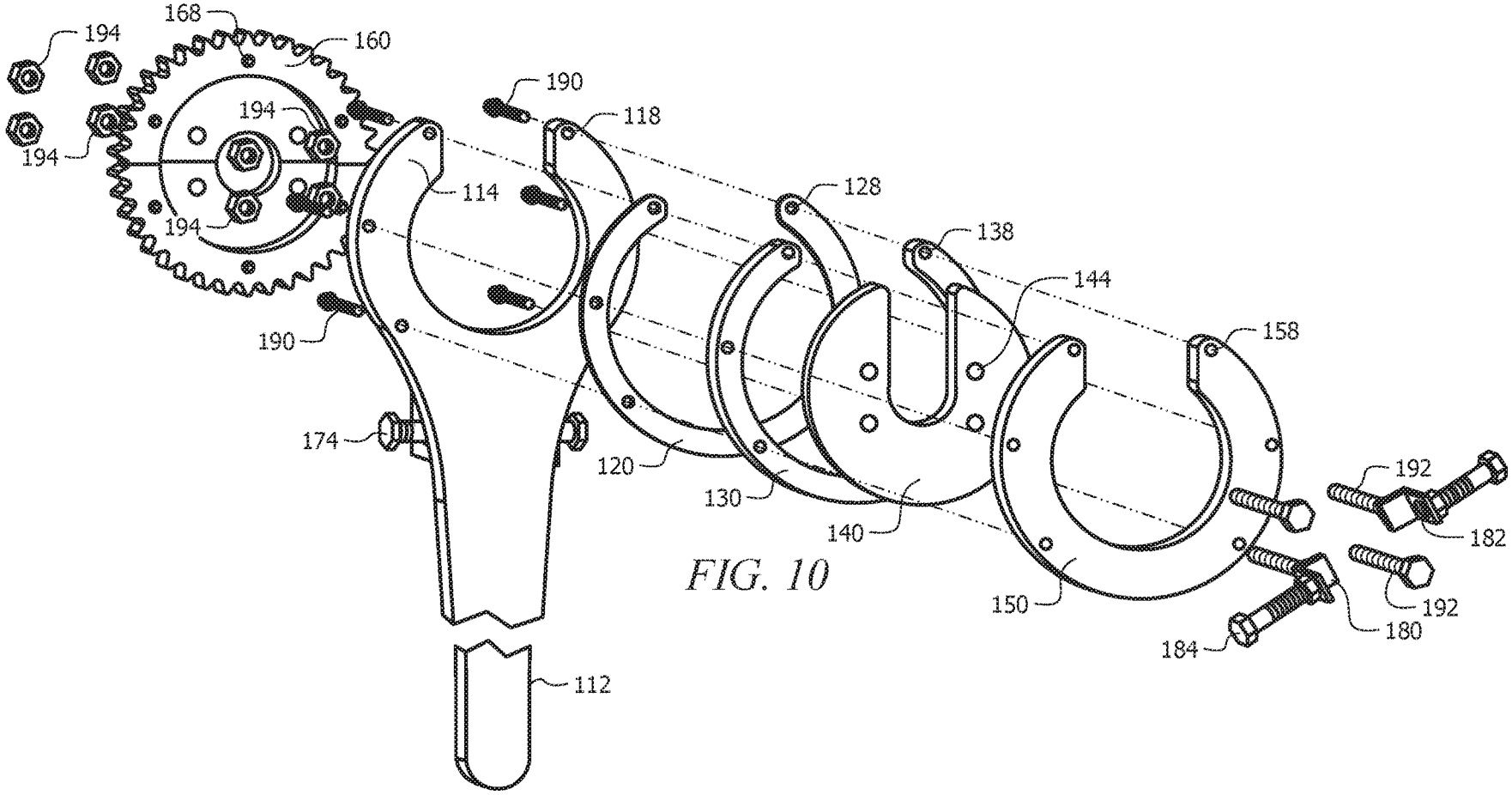
FIG. 10 is an exploded rear-and-right-side perspective view of the torsion spring winding assembly of FIG. 6.

FIG. 10 depicts an exploded perspective view of the embodiment of FIG. 6, showing how the components of the assembly are arranged in the alternative embodiment. As shown in FIG. 10, the various plates of the assembly are secured against each other via screws 190 inserted within attachment holes 118, 128, 138, and 158, respectively. Moreover, ring gear 160 is in mechanical communication with U-plate 140 via bolts 192. which are inserted within central attachment holes 144 disposed within U-plate 140. Bolts 192 are secured against ring gear 160 via nuts 194. L-brackets 180 are in mechanical communication with ring gear 160, since at least two L-brackets 180 are secured against at least two bolts 192, such as via welding, adhering, or other attachment mechanisms. As such, when ring gear 160 rotates, U-plate 140 rotates within first horseshoe plate 130, and L-brackets 180 consequently rotates. Second horseshoe plate 150 prevents U-plate 140 from slipping or otherwise falling out of position within the assembly. When L-brackets 180 rotate, and when L-brackets 180 are secured against a torsion spring, the torsion spring in turn rotates and can he wound and unwound by a user. Moreover, FIG. 10 depicts that each of the components including head 114, spacer 120, first horseshoe plate 130, U-plate 140, and second horseshoe plate 150 has a discontinuous circumference, creating two free ends that establish a lateral passage into a central receiving space, and ultimate into centrally-disposed aperture 166. As such, the assembly is designed to receive, surround, and secure against a torsion rod, as described below.

Figure 11:
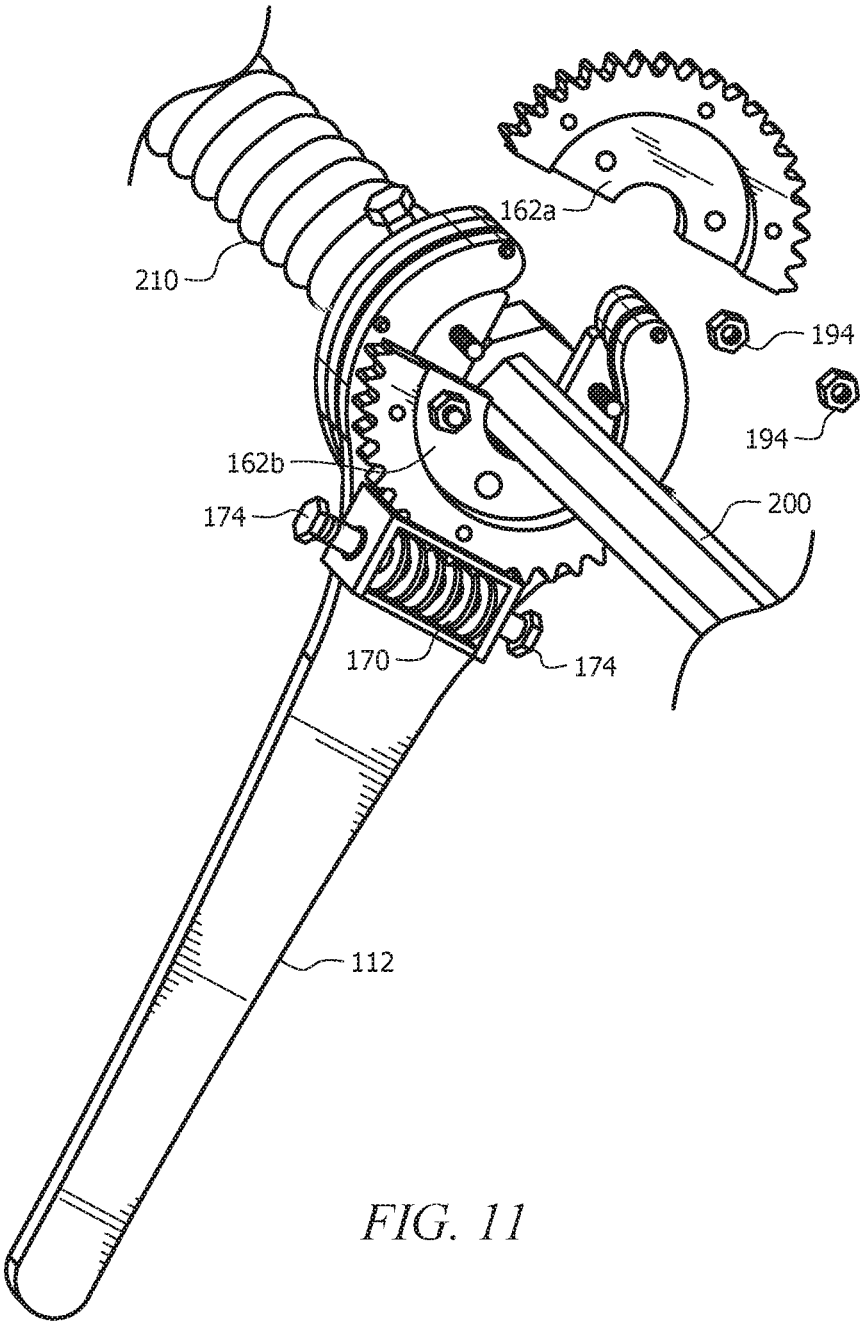
FIG. 11 is a front-perspective view of the torsion spring winding assembly of FIG. 6 used in combination with a torsion spring and a torsion rod.

FIG. 11 depicts the embodiment of the assembly shown in FIG. 6 in use; however, it is understood that the embodiment of the assembly shown in FIG. 1 is used in a similar manner, with the difference between the embodiments being the orientation of the internal components. As shown in FIG. 11, referring to ring gear 160, first hemispherical component 162*a* of support plate 162 separates from second hemispherical component 162*b* of inner circle 162. First hemispherical component 162*a* can separate from head 114 by removing at least two of nuts 194, which secure against bolts 192 to maintain the mechanical communication between ring gear 160, U-plate 140, and L-brackets 180. With at least two of nuts 194 removed, first hemispherical component 162*a* can separate from second hemispherical component 162*b* The separation of first and second hemispherical components 162*a* and 162*b*, together with the openings between the first and second portions of head 114, spacer 120, first horseshoe plate 130, U-plate 140, and second horseshoe plate 150 allow the tool assembly to surround torsion rod 200, on which torsion spring 210 is wound. After the tool assembly surrounds torsion rod 200, first hemispherical component 162*a* can be reattached to the assembly via nuts 194 and bolts 192, such that first and second hemispherical components 162*a* and 162*b* secure about torsion rod 200, with torsion rod 200 being disposed within central aperture 166 of ring gear 160.

Figure 12:
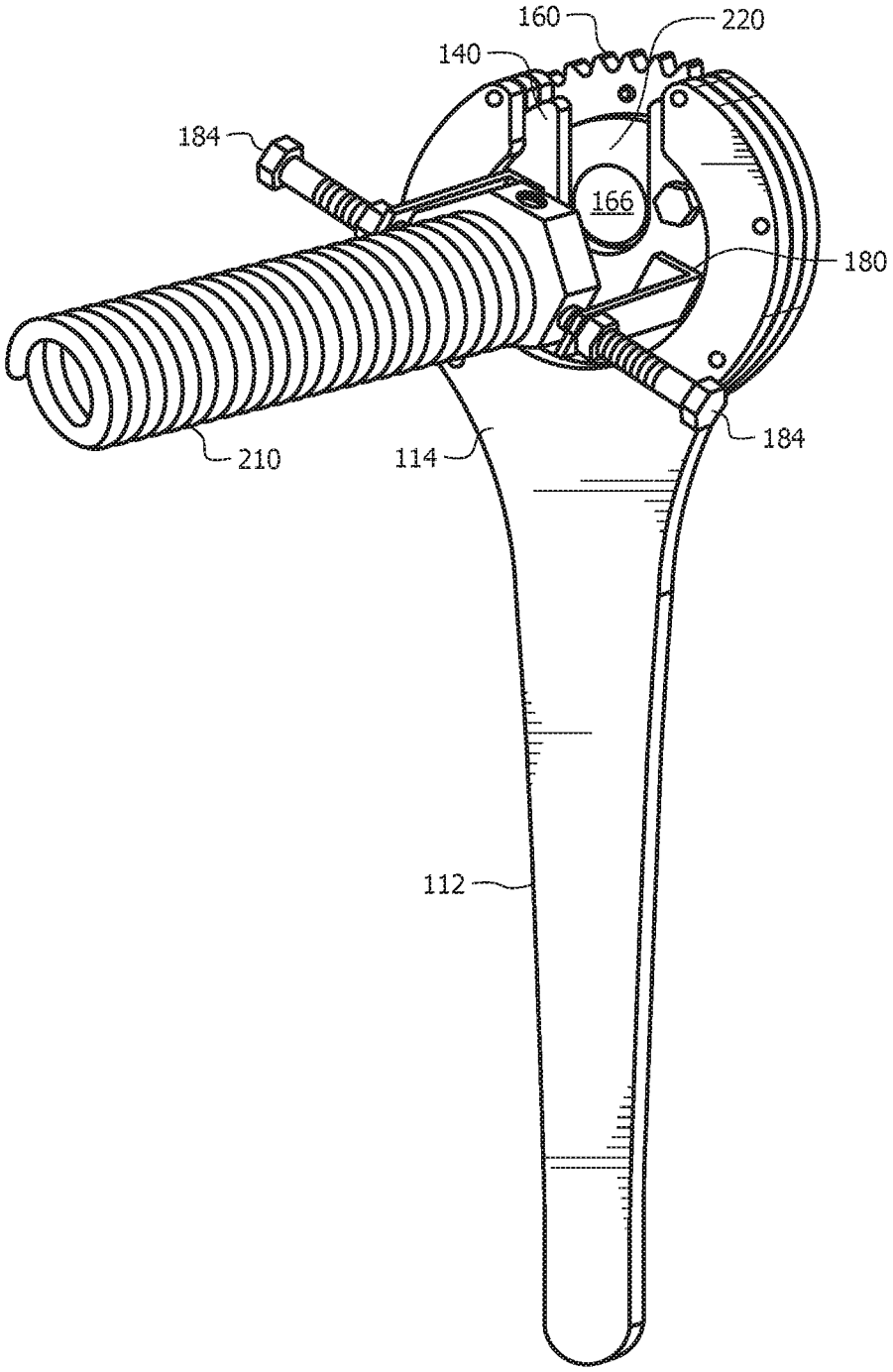
FIG. 12 is a rear-perspective view of the torsion spring winding assembly of FIG. 6 used in combination with a torsion spring and a torsion rod.

FIG. 12 depicts the rear side of the assembly of FIG. 11, after first hemispherical component 162*a* is reattached to the assembly, and support plate 162 of ring gear 160 surrounds torsion rod 200. As shown in FIG. 12, torsion spring 210 includes a plurality of attachment points 220. In typical torsion spring 210 replacement and installation, a user must utilize a set of elongated rods insertable within at least two of attachment points 220. The elongated rods are used to rotate torsion spring 210, typically in quarter-turns, to either wind or unwind torsion spring 210. However, since such installation and removal methods are dangerous and physically taxing, an embodiment of the present invention secures torsion spring attachment bolts 184 of L-brackets 180 within attachment points 220. Torsion spring attachment bolts 184 are insertable through apertures 182 disposed within L-brackets 180, such that torsion spring attachment bolts 184 secure within attachments points 220 of torsion spring 210. As such, when L-brackets 180 are rotated within the assembly when ring gear 160 rotates, torsion spring 210 rotates to either wind or unwind, depending on whether torsion spring 210 is being installed or removed, respectively.

Figure 13:
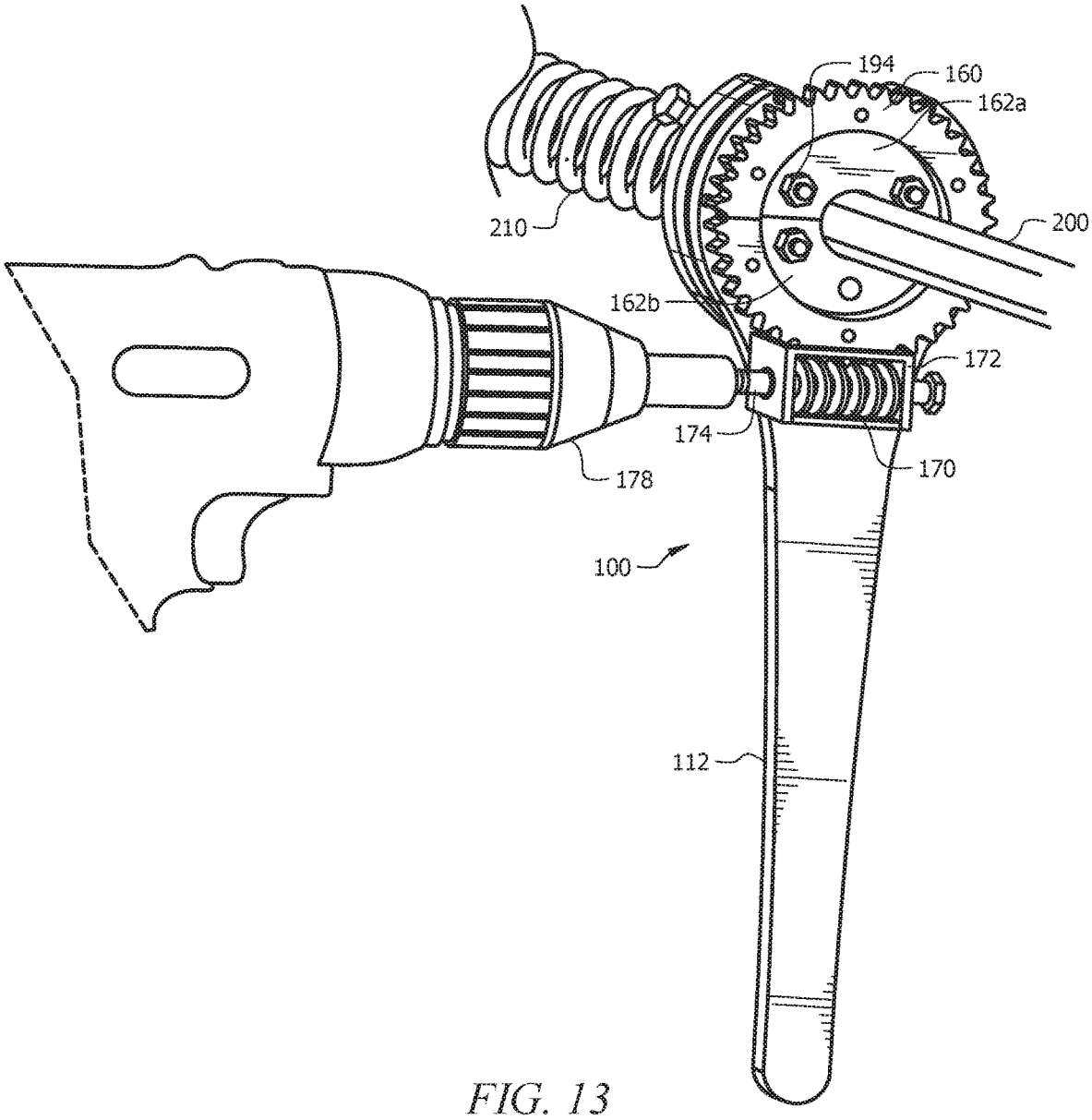
FIG. 13 is a front-perspective view of an assembly including a drill and the torsion spring winding assembly of FIG. 6, the assembly used in combination with a torsion spring and a torsion rod.

FIG. 13 depicts torsion spring winding assembly 100, including tool 178 in addition to the assembly including ring gear 160 and head 114. Tool 178 is depicted as a drill; however, it is understood that tool 178 need not be a drill, but could be a wrench, screwdriver, ratchet, or other tool capable of attaching to the assembly by mating with attachment point 174 to rotate worm gear 170. Regardless of whether tool 178 is a drill, wrench, screwdriver, ratchet, or other tool, as shown in FIG. 13, tool 178 secures against the assembly by mating with attachment point 174 of holder 172 of worm gear 170. As discussed above, attachment point 174 is in mechanical communication with worm gear 170, such that a rotation of attachment point 174 consequently rotates worm gear 170. Moreover, as discussed above, a rotation of worm gear 170 consequently rotates ring gear 160, which in turn rotates L-brackets 180. When the assembly is secured against torsion spring 210 and torsion rod 200, such as the configuration shown in FIGS. 11-13, the rotation of worm gear 170 also rotates torsion spring 210 about torsion rod 200. Depending on the direction of rotation (clockwise or counter-clockwise), torsion spring 210 is either wound or unwound. As such, by utilizing torsion spring winding assembly 100, a user can easily, efficiently, and safely install or replace torsion spring 210 without the need to manually rotate torsion spring 210, which can be dangerous and physically taxing. In an embodiment, worm gear 170 completes forty rotations to rotate ring gear 160 one time (a 40:1 ration between worm gear 170 and ring gear 160). Moreover, torsion spring 210 must be turned seven or eight times to install or remove torsion spring 210. As such, in an embodiment, 280-320 worm gear rotations are required to wind or unwind torsion spring 210, such that a power drill is useful as tool 178.

The advantages set forth above, and those made apparent from the foregoing description, are efficiently attained. Since certain changes may be made in the above construction without departing from the scope of the invention, it is intended that all matters contained in the foregoing description or shown in the accompanying drawings shall be interpreted as illustrative and not in a limiting sense.

It is also to be understood that the following claims are intended to cover all of the generic and specific features of the invention herein described, and all statements of the scope of the invention that, as a matter of language, might be said to fall therebetween.

What is claimed is:

1. A spring winding assembly comprising:

a base including a handle opposite a head, the head including a first portion and a second portion separated by an opening;

a worm gear disposed on the base between the handle and the head;

a ring gear disposed proximate to a front side of the base in mechanical communication with the worm gear, the ring gear including a first hemispherical component opposite and separable from a second hemispherical component, with an aperture centrally-disposed within the ring gear, the aperture partially defined by at least a portion of each of the first hemispherical component and the second hemispherical component;

at least two brackets disposed proximate to a rear side of the base, the at least two brackets in mechanical communication with the ring gear, such that the at least two brackets are indirectly secured to the ring gear;

a U-plate disposed between the base and the ring gear, the U-plate including at least two through-holes disposed therein, the U-plate in mechanical communication with the ring gear;

at least two bolts secured to the ring gear and inserted through the at least two through-holes of the U-plate, each of the at least two brackets secured against one of the at least two bolts;

a first horseshoe-shaped plate having an inner diameter greater than an outer diameter of the U-plate, the U-plate disposed within and in mechanical communication with the first horseshoe-shaped plate, such that the U-plate rotates within the first horseshoe-shaped plate; and a second horseshoe-shaped plate disposed between the first horseshoe-shaped plate and the ring gear, the second horseshoe-shaped plate having an inner diameter smaller than the inner diameter of the first horseshoe-shaped plate and the U-plate rest against the second horseshoe-shaped plate, wherein the U-plate is rotatable against the second horseshoe-shaped plate and within the first horseshoe-shaped plate, wherein the at least two brackets are couplable to a torsion spring including at least two attachment points, and wherein a rotation of the worm gear rotates the ring gear and the at least two brackets, thereby rotating the torsion spring to wind or unwind the torsion spring.

2. The spring winding assembly of claim 1, further comprising:

a spacer plate disposed between the first horseshoe-shaped plate and the head of the base, the spacer plate separating the first horseshoe-shaped plate from the head of the base, and separating the U-plate from the head of the base, such that the U-plate can rotate.

3. The spring winding assembly of claim 1, wherein the centrally-disposed aperture of the ring gear is configured to surround a torsion rod upon which the torsion spring is wound.

4. The spring winding assembly of claim 1, further comprising:

a holder within which the worm gear is disposed, the holder including at least one attachment point disposed thereon, the at least one attachment point in mechanical communication with the worm gear, such that a mechanical translation of the at least one attachment point rotates the worm gear.

5. The spring winding assembly of claim 4, further comprising:

a tool couplable to the at least one attachment point, wherein the tool is configured to mechanically translate the at least one attachment point and consequently rotate the worm gear, thereby rotating the ring gear and the at least two brackets securable to the torsion spring.

6. The torsion spring winding assembly of claim 5, wherein the tool is a drill couplable to the at least one attachment point.

7. A torsion spring winding assembly comprising:

a base including a handle opposite a head, the head including a first portion and a second portion separated by an opening;

a worm gear disposed on the base between the handle and the head;

a ring gear disposed proximate to a front side of the base in mechanical communication with the worm gear, the ring gear including a first hemispherical component opposite and separable from a second hemispherical component, with an aperture centrally-disposed within the ring gear, the aperture partially defined by at least a portion of each of the first hemispherical component and the second hemispherical component;

at least two through-holes disposed within the ring gear, with at least two bolts insertable through the at least two through-holes;

a U-plate disposed proximate to a rear side of the base, the U-plate including at least two through-holes disposed therein to receive the at least two bolts therethrough, the U-plate in mechanical communication with the ring gear via the at least two bolts;

a first horseshoe-shaped plate having an inner diameter greater than an outer diameter of the U-plate, the U-plate disposed within and in mechanical communication with the first horseshoe-shaped plate, such that the U-plate rotates within the first horseshoe-shaped plate; and at least two brackets disposed proximate to the U-plate, such that the U-plate is disposed between the base and the at least two brackets, each of the at least two brackets secured to one of the at least two bolts, such that the at least two brackets are in mechanical communication with the ring gear, wherein the at least two brackets are couplable to a torsion spring including at least two attachment points, and wherein a rotation of the worm gear rotates the ring gear, the U-plate, and the at least two brackets, thereby rotating the torsion spring to wind or unwind the torsion spring.

8. The torsion spring winding assembly of claim 7, further comprising:

a second horseshoe-shaped plate disposed between the first horseshoe-shaped plate and the at least two brackets, the second horseshoe-shaped plate having an inner diameter smaller than the inner diameter of the first horseshoe-shaped plate, such that the first horseshoe-shaped plate and the U-plate rest against the second horseshoe-shaped plate, wherein the U-plate is rotatable against the second horseshoe-shaped plate and within the first horseshoe-shaped plate.

9. The torsion spring winding assembly of claim 7, further comprising:

a spacer plate disposed between the first horseshoe-shaped plate and the head of the base, the spacer plate separating the first horseshoe-shaped plate from the head of the base, and separating the U-plate from the head of the base, such that the U-plate can rotate.

10. The torsion spring winding assembly of claim 7, wherein the centrally-disposed aperture of the ring gear is configured to surround a torsion rod upon which the torsion spring is wound.

11. The torsion spring winding assembly of claim 7, further comprising:

at least one attachment point in mechanical communication with the worm gear, such that a mechanical translation of the at least one attachment point rotates the worm gear; and a tool couplable to the at least one attachment point, wherein the tool is configured to mechanically translate the at least one attachment point and consequently rotate the worm gear, thereby rotating the ring gear and the at least two brackets securable to the torsion spring.

12. A torsion spring winding assembly comprising:

a base including a handle opposite a head, the head including a first portion and a second portion separated by an opening;

a worm gear disposed on the base between the handle and the head, with at least one attachment point in mechanical communication with the worm gear;

a ring gear disposed proximate to a front side of the base in mechanical communication with the worm gear, the ring gear including a first hemispherical component opposite and separable from a second hemispherical component, with an aperture centrally-disposed within the ring gear, the aperture partially defined by at least a portion of each of the first hemispherical component and the second hemispherical component;

at least two through-holes disposed within the ring gear, with at least two bolts insertable through the at least two through-holes;

at least two brackets disposed proximate to a rear side of the base, each of the at least two brackets secured to one of the at least two bolts, such that the at least two brackets are in mechanical communication with the ring gear;

a U-plate disposed between the base and the at least two brackets, the U-plate including at least two through-holes disposed therein to receive the at least two bolts therethrough, the U-plate in mechanical communication with the ring gear via the at least two bolts;

a first horseshoe-shaped plate having an inner diameter greater than an outer diameter of the U-plate, the U-plate disposed within and in mechanical communication with the first horseshoe-shaped plate, such that the U-plate rotates within the first horseshoe-shaped plate; and a second horseshoe-shaped plate disposed between the first horseshoe-shaped plate and the at least two brackets, the second horseshoe-shaped plate having an inner diameter smaller than the inner diameter of the first horseshoe-shaped plate, such that the first horseshoe-shaped plate and the U-plate rest against the second horseshoe-shaped plate, wherein the U-plate is rotatable against the second horseshoe-shaped plate and within the first horseshoe-shaped plate, wherein the at least two brackets are couplable to a torsion spring including at least two attachment points, and wherein a rotation of the worm gear rotates the ring gear, the L-plate, and the at least two brackets, thereby rotating the torsion spring to wind or unwind the torsion spring.

* * * * *